US005686156A

United States Patent [19]

Matsui et al.

[11] Patent Number: 5,686,156

[45] Date of Patent: Nov. 11, 1997

[54] PRESS-THROUGH PACKAGE

[75] Inventors: Toshiyasu Matsui; Tsutomu Hani, both of Yokohama; Teiji Kohara, Kawasaki; Tadao Natsuume, Yokosuka, all of Japan

[73] Assignee: Nippon Zeon Co., Ltd., Tokyo, Japan

[21] Appl. No.: 464,630

[22] PCT Filed: Jan. 28, 1994

[86] PCT No.: PCT/JP94/00122

§ 371 Date: Jun. 26, 1995

§ 102(e) Date: Jun. 26, 1995

[87] PCT Pub. No.: WO94/16965

PCT Pub. Date: Aug. 4, 1995

[30] Foreign Application Priority Data

Jan. 29, 1993 [JP] Japan ..... 5-034849
Mar. 30, 1993 [JP] Japan ..... 5-095520

[51] Int. Cl.[6] ..... B65D 83/04

[52] U.S. Cl. ..... 428/36.6; 428/35.7; 206/531; 220/507

[58] Field of Search ..... 220/507; 206/531, 206/532; 428/35.7, 36.6

[56] References Cited

U.S. PATENT DOCUMENTS 5,360,116 11/1994 Schmiletzky ..... 206/531

*Primary Examiner*—Charles Nold
*Attorney, Agent, or Firm*—Armstrong, Westerman, Hattori, McLeland & Naughton

[57] ABSTRACT

A press-through package obtained by placing objects to be packed, in the accommodating pockets formed by vacuum forming or the like of a sheet made of a thermoplastic norbornene type resin, particularly preferably a hydrogenated product of ring-opening polymerization product of a dicyclopentadiene type monomer, and then closing the openings of pockets of the sheet with another sheet such as metal foil to pack the objects to be packed, which package makes the packed objects clearly visible in the pocket portions, prevents the deterioration of the packed objects by moisture bacause of its excellent water vapor barrier properties, and is good in production efficiency.

11 Claims, No Drawings

PRESS-THROUGH PACKAGE

TECHNICAL FIELD

The present invention relates to a press-through package and more particularly it relates to a press-through package excellent in water vapor barrier properties.

BACKGROUND ART

A synthetic resin sheet as a base material for a press-through package (hereinafter referred to as PTP) is preferably so transparent that packed objects are clearly visible in the pocket portions of the sheet. Furthermore, for preventing the change in properties of the packed objects caused by moisture, it is preferable that the sheet has a low water vapor transmission rate. Sheets made of a poly(vinyl chloride) or a polypropylene have been used. In addition, laminated sheets of a polypropylene and a poly(vinylidene fluoride) have been used in PTP's which are particularly required to have water vapor barrier properties.

Poly(vinyl chloride)s, however, have been disadvantageous in that they do not have a water vapor transmission rate sufficiently low to pack a drug easily changeable in properties by moisture and are difficult to incinerate after use. On the other hand, polypropylenes have been disadvantageous as follows: they are not good in vacuum forming properties, so that when the openings of pockets are formed in a sheet by vacuum forming, the thickness of the pocket portions tends to become nonuniform; and molded sheets of the polypropylenes are liable to be curled and hence are poor in workability. The laminated sheets of a polypropylene and a poly(vinylidene fluoride) have been disadvantageous in not only being unsatisfactory in vacuum forming properties, workability, etc. but also being difficult to incinerate.

DISCLOSURE OF THE INVENTION

The present inventors found that when a sheet made of a thermoplastic norbornene type resin is used as a synthetic resin sheet used as a base material for PTP, it has a low water vapor transmission rate, is easy to incinerate, and can give pockets uniform in their thickness in the formation of the openings of the pockets by vacuum forming, whereby the present invention has been accomplished.

Thus, according to present invention, there is provided a PTP obtained by placing objects to be packed, in accommodating pockets formed in a sheet made of a thermoplastic norbornene type resin, and then closing the openings of pockets of the sheet with another sheet to pack the objects to be packed.

BEST MODE FOR CARRYING OUT THE INVENTION

(Thermoplastic Norbornene Type Resin)

The thermoplastic norbornene type resin used in the present invention is a resin well known in Japanese Patent Unexamined Publication Nos. 51-80400, 60-26024, 1-168725, 1-190726, 3-14882, 3-122137 and 4-63807, etc. Specific examples of the thermoplastic norbornene type resin are ring-opening polymerization products of norbornene type monomers, hydrogenated products thereof, addition polymers of norbornene type monomers, and addition polymers of a norbornene type monomer and an olefin.

The norbornene type monomers are monomers also well known in the above references, Japanese Patent Unexamined Publication Nos. 2-227424 and 2-276842, etc. and include, for example, norbornene, alkyl-, alkylidene- or aromatic-substituted derivatives of norbornene, and substituted products of these substituted or unsubstituted olefins, which have as the substituent(s) one or more polar groups selected from halogens, hydroxyl group, ester groups, alkoxy groups, cyano group, amide group, imide group, silyl group, etc., for instance, 2-norbornene, 5-methyl-2-norbornene, 5,5-dimethyl-2-norbornene, 5-ethyl-2-norbornene, 5-butyl-2-norbornene, 5-ethylidene-2-norbornene, 5-methoxycarbonyl-2-norbornene, 5-cyano-2-norbornene, 5-methyl-5-methoxycarbonyl-2-norbornene, 5-phenyl-2-norbornene, 5-phenyl-5-methyl-2-norbornene, 5-hexyl-2-norbornene, 5-octyl-2-norbornene and 5-octadecyl 2-norbornene; monomers formed by addition of one or more molecules of cyclopentadiene to norbornene, and the same derivatives and substituted products as above of these monomers, for instance, 1,4:5,8-dimethano-1,2,3,4,4a,5,8,8a-2,3-cyclopentadienooctahydro-naphthalene, 6-methyl-1,4:5,8-dimethano-1,4,4a,5,6,7,8,8a-octahydronaphthalene, and 1,4:5,10:6,9-trimethano-1,2,3,4,4a,5,5a,6,9,9a,10,10a-dodecahydro-2,3-cyclopentadienoanthracene; monomers of a polycyclic structure which are oligomers of cyclopentadiene, and the same derivatives and substituted products as above of these monomers, for instance, dicyclopentadiene (hereinafter referred to as DCP) and 2,3-dihydrodicyclopentadiene; adducts of cyclopentadiene with tetrahydroindene or the like, and the same derivatives and substituted products as above of the adducts, for instance, 1,4-methano-1,4,4a,4b,5,8,8a,9-a-octahydrofluorene and 5,8-methano-1,2,3,4,4a,5,8,8a-octahydro-2,3-cyclopentadienonaphthalene.

When the norbornene type monomer is polymerized in the present invention, it can be made into a copolymer by co-using another polymerizable cycloolefin or the like in such an amount that the effect of the present invention is not substantially lessened. Specific examples of the copolymerizable cycloolefin used in the ring-opening polymerization are compounds having one or more reactive double bonds, such as cyclopentene, cyclooctene, etc.

The norbornene type monomer may be polymerized by a conventional method and is usually polymerized by using as a polymerization catalyst a combination of a transition metal compound (e.g. $TiCl_4$, $WCl_6$, $MoCl_5$, $VCl_5$, $NiCl_2$ or $PdCl_2$) and an alkyl compound of a typical metal (e.g. Al, Li, Na or Mg). If necessary, a hydrogenated product of thermoplastic norbornene type resin can be obtained by a conventional method, for example, hydrogenation using Ni, Pd or the like as a catalyst.

When a heretofore well-known polymerization method is employed, a transition metal derived from a polymerization catalyst remains in the resulting polymer. When the packed object of a PTP is a drug or food, the dissolution of the transition metal remaining in the resin is not desirable, and it is preferable that the transition metal does not substantially remain in the resin. For this purpose, it is preferable to use a resin in which the amount of transition metal atoms derived from the polymerization catalyst has been reduced to 1 ppm or less by hydrogenating the polymer by the use of a heterogeneous catalyst obtained by supporting a hydrogenation catalyst metal such as nickel on an adsorbent such as alumina with a pore volume of 0.5 $cm^3/g$ or more, preferably 0.7 $cm^3/g$ or more and a specific surface area of preferably 250 $cm^2/g$ or more, or treating a resin solution with such an adsorbent to adsorb metal atoms, or washing the resin solution with acidic water and pure water repeatedly.

As a process for producing the heterogeneous catalyst, a conventional process may be employed. It is sufficient that the adsorption capacity of a carrier is controlled by choosing drying and calcination conditions according to any of the processes well known in Japanese Patent Post-examined Publication Nos. 50-15474, 49-32187, 49-11312 and 51-48479, etc. For example, in the case of a heterogeneous catalyst obtained by supporting nickel on activated alumina, aluminum hydroxide powder is suspended in an aqueous nickel sulfate or nickel nitrate solution with a concentration of 10 to 20% to an concentration of 10 to 20%, followed by hydrolysis with sodium hydroxide, whereby nickel hydroxide is supported on the surface of the aluminum hydroxide. This powder is recovered by filtration, hardened into a mass by extrusion, calcined at 350°–450° C., brought into contact with hydrogen at 100°–200° C. to reduce the surface, and then heated at 80°–120° C. in the presence of oxygen to oxidize the metal surface, giving an oxide film, whereby a nickel catalyst supported on activated alumina is obtained. The nickel surface is covered with nickel oxide, but in a hydrogenation reaction system, the nickel oxide is converted into nickel by reduction to function as a catalyst.

Since the fine structure of the activated alumina changes depending on the extrusion conditions, the calcination temperature, the calcination pressure, etc., conditions are chosen so as to give a pore volume of 0.5 $cm^3/g$ or more, preferably 0.7 $cm^3/g$ or more, and a specific surface area of preferably 250 $cm^2/g$ or more. In addition, when the hydrogenation is carried out at a high temperature, the thicker the oxide film, the higher its heat resistance. Therefore, preferable conditions are chosen by controlling the oxidation temperature, oxidation time, oxygen concentration, etc. The heterogeneous catalyst can be obtained by grinding the calcined product thus obtained.

When a transition metal chloride is used as a transition metal compound used as a conventional polymerization catalyst, chlorine atoms also usually remain in an amount of 2 ppm or more. Like the transition metal atoms, the chlorine atoms are preferably prevented from remaining in medical appliances and are preferably removed. As to a method for the removal, the chlorine atoms can be removed by the same treatment as for the transition metal atoms, and the amount of remaining chlorine atoms can be reduced to 1 ppm or less.

The number average molecular weight of the thermoplastic norbornene type resin used in the present invention is 10,000 to 200,000, preferably 15,000 to 100,000, more preferably 20,000 to 50,000, in terms of polystyrene, as measured by GPC (gel permeation chromatography) using toluene as solvent. When the thermoplastic norbornene type resin has unsaturated bonds in the molecular structure, it can be converted into a thermoplastic saturated norbornene type resin by hydrogenation. When the hydrogenation is carried out, the hydrogenation rate is 90% or more, preferably 95% or more, more preferably 99% or more, from the viewpoint of heat deterioration resistance, light stability, etc.

Of the thermoplastic norbornene type resins, thermoplastic saturated norbornene type resins excellent in heat deterioration resistance, light stability, etc. are preferable. Hydrogenated products of ring-opening polymerization products of norbornene type monomers which are excellent in moldability are more preferable. Hydrogenated products of ring-opening polymerization products of DCP type monomers which are excellent in water vapor barrier properties are still more preferable. The hydrogenated products of ring-opening polymerization products of DCP type monomers are obtained by hydrogenation of a polymer containing 50% by weight or more of ring-opened repeating structural units derived from a DCP type monomer such as DCP, an alkyl-,alkylidene- or aromatic-substituted derivative of DCP, or a substituted product thereof having as the substituent(s) one or more polar groups selected from halogens, hydroxyl group, ester groups, alkoxy groups, cyano group, amide group, imide group, silyl group, etc. In addition, of the hydrogenated products of ring-opening polymerization products of DCP type monomers, those containing no polar group are preferable from the viewpoint of water vapor barrier properties. Preferable is a hydrogenated product of ring-opening polymerization product of only a DCP type monomer containing no polar group, or a hydrogenated product of ring-opening copolymerization product of a DCP type monomer containing no polar group and another monomer, i.e., norbornene, 1,4:5,8-dimethano-1, 2,3,4,4a,5, 8,8a-octahydronaphthalene, or an alkyl-, alkylidene- or aromatic-substituted derivative thereof. As the hydrogenated product of ring-opening copolymerization product, the most preferable is a hydrogenated product of a ring-opening copolymerization product consisting of 70% by weight or more, in particular, 80 to 95% by weight of ring-opened repeating structural units derived from a DCP type monomer having no polar group and 30% by weight or less, in particular, 5 to 20% by weight of ring-opened repeating structural units derived from another monomer, i.e., norbornene, 1,4:5,8-dimethano 1,2,3,4,4a,5,8,8a-octahydronaphthalene, or an alkyl-,alkylidene- or aromatic-substituted derivative thereof.

The glass transition temperature (hereinafter referred to as Tg) is 50°–160° C., preferably 60°–140° C., more preferably 70°–110° C., from the viewpoint of water vapor barrier properties and vacuum forming properties. If Tg is too low, the water vapor transmission rate is high. If Tg is too high, the vacuum forming temperature is high, so that the vacuum forming becomes difficult, and a molded sheet tends to be curled or waved.

If desired, to the thermoplastic norbornene type resin used in the present invention may be added various additives, for example, antioxidants of phenolic type, phosphorus-containing type, etc.; heat deterioration resistors of phenolic type, etc.; ultraviolet absorbers of benzophenone type, etc.; antistatic agents of amine type, etc.; lubricants such as esters of aliphatic alcohols, partial esters and partial ethers of polyhydric alcohols, etc. Other resins, rubber-like polymers, etc. may be used in admixture with the thermoplastic norbornene type resin so long as they do not defeat the object of the present invention. Usually, the sheet made of the thermoplastic norbornene type resin which is used in the present invention is preferably as transparent as possible so that the packed objects may be visible from the outside. But when the objects to be packed are deteriorated by visible light, it is preferable to intercept visible light, in particular, light of 600 nm or less by adding a coloring matter, dye, pigment or the like as a light screen, in order to protect the objects to be packed.

(Sheet Made of the Thermoplastic Norbornene Type Resin)

A method for producing the sheet made of the thermoplastic norbornene type resin having pockets which is used in the present invention is not particularly limited. There can be used one of or a combination of two or more of conventional molding or shaping methods of thermoplastic resins, such as injection molding, melt extrusion, hot pressing, solvent casting, inflation, etc. For example, a sheet having no pocket is produced by a method such as solvent casting, melt extrusion, inflation or the like, after which pockets are formed by vacuum forming, pressure forming or the like.

When measured in a circumstance of 40° C. and 90 RH %, the water vapor transmission rate (in terms of a sheet thickness of 300 μm) of the sheet having no pockets usually 1.0 g/m²·24 hours or less in the case of a thermoplastic norbornene type resin and 0.6 g/m²·24 hours or less in the case of a hydrogenated product of ring-opening polymerization product of a DCP type monomer. Of hydrogenated products of ring-opening polymerization products of DCP type monomers, hydrogenated products of homopolymers produced by ring-opening polymerization of a DCP type monomer having no polar group, or hydrogenated products of copolymers produced by ring-opening copolymerization of a DCP type monomer having no polar group and norbornene, 1,4:5,8-dimethano-1,2,3,4,4a, 5,8,8a-octahydronaphthalene, or an alkyl-, alkylidene- or aromatic-substituted derivative thereof give a sheet having a water vapor transmission rate of 0.4 g/m²·24 hours or less. As such hydrogenated products of ring-opening polymerization products of DCP type monomers which have excellent water vapor barrier properties and a low water vapor transmission rate, there are exemplified hydrogenated products obtained by hydrogenating a ring-opening polymerization product containing 50% by weight or more, preferably 70% by weight or more, more preferably 80 to 95% by weight of ring-opened repeating structural units derived from a DCP type monomer having no polar group, at a hydrogenation rate of 70% or more, preferably 90% or more, particularly preferably 99% or more.

When pockets are formed by vacuum forming or the like after producing the sheet having no pocket, the sheet is preferably oriented. An oriented sheet has a lower water vapor transmission rate than does a non-oriented sheet when these sheets are molded out of the same resin and have the same thickness. The orientation is preferably uniaxial orientation. Biaxial orientation requires a complicated working process and causes a lowering of the water vapor transmission rate which is not markedly different from that in an uniaxially oriented sheet. By contrast, the uniaxial orientation may be carried out by a conventional method, can be carried out by a simple procedure (for example, in the case of the extrusion, inflation, etc., it is sufficient that the sheet is wound up on a take-off roll while being continuously oriented in the extrusion direction), is excellent in productivity, and has a marked improving effect on the water vapor transmission rate.

The orientation is carried out at a temperature of Tg to Tg+100° C., preferably Tg+10° C. to Tg+80° C. The percent of stretch is 110 to 500%, preferably 120 to 400%, more preferably 130 to 250%. If the temperature at the orientation processing is too low, the sheet tends to be broken and is poor in processability. Even if the sheet is not broken, the strength of the sheet after the orientation is deteriorated in some cases. If the orientation processing temperature is too high, the work-efficiency is lowered. If the percent of stretch is too low, the reduction of the water vapor transmission rate is not sufficient. If the percent of stretch is too high, there are problems of the deteriorated strength of the sheet after the orientation and easy formation of pinholes.

An oriented sheet having a water vapor transmission rate of 0.25 g/m²·24 hours or less can be obtained when there is used, for example, a hydrogenated product of ring-opening polymerization product of a DCP type monomer, in particular, a hydrogenated product of a homopolymer formed by ring-opening polymerization of a DCP type monomer having no polar group, or a hydrogenated product of a copolymer formed by ring-opening copolymerization of a DCP type monomer having no polar group and norbornene, 1,4:5,8-dimethano-1,2,3,4,4a,5,8,8a-octahydronaphthalene, or an alkyl-,alkylidene- or aromatic-substituted derivative thereof.

The sheet provided with accommodating pockets has a thickness in portions other than the pocket portions of 100 to 500 μm, preferably 150 to 400 μm, more preferably 200 to 350 μm, and a thickness in the pocket portions of 50 to 500 μm, preferably 70 to 350 μm, more preferably 100 to 300 μm, particularly preferably 150 to 250 μm, and its openings and accommodating pockets have shapes and dimensions which are suitable for the shape and dimensions of objects to be packed. If the sheet is too thick, there is a problem in that the sheet becomes too tough, so that the packed objects are difficult to take out. If the sheet is too thin, it is not sufficient in strength and hence is easily breakable, and moreover there is a problem of deterioration of the water vapor barrier properties. Another resin layer may be laminated on the sheet. Usually, the sheet has a transmittance for light with a wavelength of 400 to 800 nm of preferably 70% or more, more preferably 80% or more, particularly preferably 90% or more, in order that the packed objects may be clearly visible in the pocket portions.

(Objects to be Packed)

The objects to be packed of the PTP of the present invention are not particularly limited. Typical examples of the objects to be packed are pharmaceutical tablets and capsules.

(Sheet for Closing the Pockets)

The sheet for closing the pockets used in the present invention is not particularly limited so long as it has water vapor barrier properties, has a strength usually sufficient to maintain the packing, and is such that when the pocket portion is pushed, the portion shutting the pocket is easily broken, so that the packed object can easily be taken out. Usually, a sheet obtained by laminating a resin layer on each side of metal foil is used.

The metal foil has a thickness of preferably 10 to 60 μm, more preferably 15 to 50 μm, particularly preferably 20 to 40 μm, and is preferably aluminum foil from the viewpoint of water vapor barrier properties and ease of taking-out of the packed objects. If the metal foil is too thick, the packed objects are difficult to take out. If the metal foil is too thin, it is easily breakable and possesses deteriorated water vapor barrier properties.

The resin laminated on each side of the metal foil is not particularly limited, but when the object to be packed is food, a drug or the like, there is chosen a resin which does not release harmful substances by dissolution in an amount outside the maximum permissible limit. If the strength of the metal foil is not sufficient, a resin capable of reinforcing the metal foil is preferable. If the water vapor barrier properties of the metal foil are not sufficient, a resin excellent in water vapor barrier properties is preferable.

(Bonding Method)

When the objects to be packed are packed in the sheet by closing the openings of pockets with the metal foil, a method for bonding the sheet for closing to the sheet having the pockets is not particularly limited. There are, for example, a method comprising heat sealing, ultrasonic sealing, dry laminating, wet laminating or the like by the use of an adhesive, and a method comprising hot pressure bonding. There is usually employed a method comprising forming an adhesive layer on the sheet having the pockets or the sheet for closing, and placing the objects to be packed, in the pockets, followed by heat sealing. Before the bonding, the sheet having the pockets may be subjected to a pretreatment such as corona discharge treatment or plasma treatment.

As the adhesive, there can be used, for example, synthetic rubber type hot melt adhesives, special-synthetic-rubber type hot melt adhesives (e.g. styrene•ethylene•butylene•styrene•block copolymers, styrene•isoprene•styrene•block copolymers, and hydrogenated products of styrene•isoprene•styrene•block copolymers), adhesive resins such as polypropylene type maleic-anhydride-grafted resins, polyethylene type maleic-anhydride-grafted resins, terminally modified olefins (e.g. chlorinated polyolefins), olefin copolymers (e.g. ethylene-acrylic acid copolymers, ethylene•methacrylic acid copolymers and ethylene•methyl acrylate•maleic anhydride copolymers), etc.; solution adhesives of acrylic type, synthetic rubber type, urethane type, etc.; and emulsion adhesives of acrylic type, synthetic rubber type, urethane type, etc.

When the PTP is used in an environment in which the temperature changes greatly, the following methods, for example, are preferable: a flexible adhesive is used for preventing the curling of the PTP caused by the difference between the resin and the metal foil in the degrees of expansion and shrinkage, or only the peripheries of the openings of the pockets are bonded as described in Japanese Patent Unexamined Publication No. 3-14403.

EXAMPLES

The present invention is concretely illustrated below with reference to referential examples, examples and comparative examples.

Referential Example 1

A hydrogenated product of DCP ring-opening polymerization product (number average molecular weight: 26,000, glass transition temperature: 93° C., hydrogenation rate: 99.7% or more; no transition metal was detected therein) was extruded through a T-die of 400 mm width at a resin temperature of 200° C. by means of an extruder with a screw diameter of 65 mm and taken off with a roll at 85° C. to prepare a sheet of 300 μm thickness.

The sheet obtained was colorless and transparent, was free from defects such as void and fish eye and external shape imperfections such as curl, twist and waviness, and had a satisfactory appearance. The water vapor transmission rate of the sheet was measured according to the method under conditions B prescribed in JIS Z 0208 and found to be 0.26 $g/m^2 \cdot 24$ hours in the following circumstance: temperature 40° C., relative humidity 90% RH.

Referential Example 2

A hydrogenated product of ring-opening copolymerization product consisting of 70% by weight of ring-opened repeating structural units derived from DCP and 30% by weight of ring-opened repeating structural units derived from 6-methyl-1,4:5,8-dimethano-1,4,4a,5,6,7,8,8a-octahydronaphthalene (number average molecular weight: 28,000, glass transition temperature: 109° C., hydrogenation rate: 99.7% or more; no transition metal was detected therein) was extruded through a T-die of 400 mm width at a resin temperature of 215° C. by means of an extruder with a screw diameter of 65 mm and taken off with a roll at 95° C. to prepare a sheet of 300 μm thickness.

The sheet obtained was colorless and transparent, was free from defects such as void and fish eye and external shape imperfections such as curl, twist and waviness, and had a satisfactory appearance. The water vapor transmission rate was 0.32 $g/m^2 \cdot 24$ hours as measured in the same manner as in Referential Example 1.

Referential Example 3

A hydrogenated product of ring-opening polymerization product of 6-methyl-1,4:5,8-dimethano1,4,4a,5,6,7,8,8a-octahydronaphthalene (number average molecular weight: 34,000, glass transition temperature: 160° C., hydrogenation rate: 99.7% or more; no transition metal was detected therein) was extruded through a T-die of 400 mm width at a resin temperature of 260° C. by means of an extruder with a screw diameter of 65 mm and taken off with a roll at 150° C. to prepare a sheet of 300 μm thickness.

The sheet obtained was colorless and transparent, was free from defects such as void and fish eye and external shape imperfections such as curl, twist and waviness, and had a satisfactory appearance. The water vapor transmission rate was 0.76 $g/m^2 \cdot 24$ hours as measured in the same manner as in Referential Example 1.

Referential Example 4

A hydrogenated product of ring-opening polymerization product consisting of 90% by weight of ring-opened repeating structural units derived from DCP and 10% by weight of ring-opened repeating structural units derived from 6-methyl-1,4:5,8-dimethano- 1,4,4a,5,6,7,8,8a-octahydronaphthalene (number average molecular weight: 35,000, glass transition temperature: 105° C., hydrogenation rate: 99.7% or more; no transition metal was detected therein) was extruded through a T-die of 400 mm width at a resin temperature of 200° C. by means of an extruder with a screw diameter of 65 mm and taken off with a roll at 90° C. to prepare a sheet of 300 μm thickness.

The sheet obtained was colorless and transparent, was free from defects such as void and fish eye and external shape imperfections such as curl, twist and waviness, and had a satisfactory appearance. The water vapor transmission rate was 0.32 $g/m^2 \cdot 24$ hours as measured in the same manner as in Referential Example 1.

Referential Example 5

In the same manner as in Referential Example 1 except for changing the thickness to 450 μm, there was obtained a sheet which was free from defects such as void and fish eye and external shape imperfections such as curl, twist and waviness, and had a satisfactory appearance. The sheet was uniaxially oriented by a factor of 1.5 by means of a clip tenter in a circumstance of 130° C. to obtain a sheet of 300 μm thickness.

The sheet obtained was colorless and transparent, was free from defects such as void and fish eye and external shape imperfections such as curl, twist and waviness, and had a satisfactory appearance. The water vapor transmission rate was 0.19 $g/m^2 \cdot 24$ hours as measured in the same manner as in Referential Example 1.

Referential Example 6

In the same manner as in Referential Example 2 except for changing the thickness to 450 μm, there was obtained a sheet which was free from defects such as void and fish eye and external shape imperfections such as curl, twist and waviness, and had a satisfactory appearance. The sheet was uniaxially oriented by a factor of 1.5 by means of a clip tenter in a circumstance of 140° C. to obtain a sheet of 300 μm thickness.

The sheet obtained was colorless and transparent, was free from defects such as void and fish eye and external shape imperfections such as curl, twist and waviness, and had a satisfactory appearance. The water vapor transmission rate was 0.23 g/m$^2$·24 hours as measured in the same manner as in Referential Example 1.

Referential Example 7

In the same manner as in Referential Example 3 except for changing the thickness to 430 μm, there was obtained a sheet which was free from defects such as void and fish eye and external shape imperfections such as curl, twist and waviness, and had a satisfactory appearance. The sheet was uniaxially oriented by a factor of 1.5 by means of a clip tenter in a circumstance of 220° C. to obtain a sheet of 300 μm thickness.

The sheet obtained was colorless and transparent, was free from defects such as void and fish eye and external shape imperfections such as curl, twist and waviness, and had a satisfactory appearance. The water vapor transmission rate was 0.60 g/m$^2$·24 hours as measured in the same manner as in Referential Example 1.

Referential Example 8

In the same manner as in Referential Example 4 except for changing the thickness to 445 μm, there was obtained a sheet which was free from defects such as void and fish eye and external shape imperfections such as curl, twist and waviness, and had a satisfactory appearance. The sheet was uniaxially oriented by a factor of 1.5 by means of a clip tenter in a circumstance of 130° C. to obtain a sheet of 300 μm thickness.

The sheet obtained was colorless and transparent, was free from defects such as void and fish eye and external shape imperfections such as curl, twist and waviness, and had a satisfactory appearance. The water vapor transmission rate was 0.22 g/m$^2$·24 hours as measured in the same manner as in Referential Example 1.

Example 1

The sheet obtained in Referential Example 1 was fixed in a vacuum mold composed of a bottom mold having pockets with an opening diameter of 14 mm, a bottom diameter of 12 mm and a depth of 5 mm located at 3-mm intervals in 6 longitudinal rows and 2 transverse rows and a top mold having convexities with an bottom diameter of 12 mm, a top diameter of 10 mm and a height of 4 mm which fit into the pockets of the bottom mold and were located at 5-mm intervals in 6 longitudinal rows and 2 transverse rows, with the bottom and top molds opened. The sheet was preheated at 140° C. for 1 minute, after which closing of the bottom mold and the top mold and pressure reduction in the pocket portions were carried out at the same time, whereby a sheet having pockets was produced.

This sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 190 μm and the thickness of side of the pocket 120 μm.

The surface of this sheet which was to be bonded to a sheet for closing was coated with a polypropylene type maleic-anhydride-grafted resin adhesive (MODIC M410F, mfd. by Mitsubishi Petrochemical Co., Ltd.) and dried to form an adhesive layer of about 10 μm thickness. Each pocket was packed with 0.25 g of silica gel, after which the sheet for closing composed of aluminum foil of 22 μm thickness was attached and the surface to be bonded was heated at 100° C. and pressured-bonded, whereby a PTP was produced. The adhesion between the sheet having the pockets and the sheet for closing was good.

After the PTP was kept in a circumstance of 40° C. and 90 RH % for 5 days, the average increase in weight per pocket was measured and found to be 10.4 mg.

Example 2

A sheet having pockets was produced in the same manner as in Example 1 except for using the sheet obtained in Referential Example 2 in place of the sheet obtained in Referential Example 1 and changing the preheating temperature of the mold to 150° C. Thus prepared sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 110 μm and the thickness of side of the pocket 165 μm.

Using said sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 14.3 mg.

Example 3

A sheet having pockets was produced in the same manner as in Example 1 except for using the sheet obtained in Referential Example 3 in place of the sheet obtained in Referential Example 1 and changing the preheating temperature of the mold to 200° C. This sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 180 μm and the thickness of side of the pocket 125 μm.

Using this sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 29.8 mg.

Example 4

A sheet having pockets was produced in the same manner as in Example 1 except for using the sheet obtained in Referential Example 4 in place of the sheet obtained in Referential Example 1. This sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 170 μm and the thickness of side of the pocket 120 μm.

Using this sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 12.7 mg.

Example 5

A sheet having pockets was produced in the same manner as in Example 1 except for using the sheet obtained in Referential Example 5 in place of the sheet obtained in Referential Example 1. This sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 180 μm and the thickness of side of the pocket 130 μm.

Using this sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 7.9 mg.

Example 6

A sheet having pockets was produced in the same manner as in Example 1 except for using the sheet obtained in Referential Example 6 in place of the sheet obtained in Referential Example 1. This sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 160 μm and the thickness of side of the pocket 120 μm.

Using this sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 10.6 mg.

Example 7

A sheet having pockets was produced in the same manner as in Example 1 except for using the sheet obtained in Referential Example 7 in place of the sheet obtained in Referential Example 1. This sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 170 μm and the thickness of side of the pocket 125 μm.

Using this sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 23.7 mg.

Example 8

A sheet having pockets was produced in the same manner as in Example 1 except for using the sheet obtained in Referential Example 8 in place of the sheet obtained in Referential Example 1. This sheet had a satisfactory transfer of the shape of the mold, was colorless and transparent, was free from defects such as void and fish eye and external shape imperfections such as curl, twist, waviness, and thickness nonuniformity, and had a good appearance. The thickness of bottom of the pocket was 170 μm and the thickness of side of the pocket 120 μm.

Using this sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 9.3 mg.

Comparative Example 1

A sheet having pockets was produced in the same manner as in Example 1 except for using a poly(vinyl chloride) sheet of 300 μm thickness in place of the sheet obtained in Referential Example 1 and changing the preheating temperature of the mold to 125° C. This sheet had a satisfactory transfer of the shape of the mold, was colorless and transparent, was free from defects such as void and fish eye and external shape imperfections such as curl, twist and waviness, and had a good appearance. The thickness of bottom of the pocket was 160 μm and the thickness of side of the pocket 135 μm.

Using this sheet, a PTP was produced in the same manner as in Example 1. The adhesion between the sheet having the pockets and the sheet for closing was good. After the PTP was kept in a circumstance of 40° C. and 90 RH % for 5 days, the average increase in weight per pocket was measured and found to be 137.2 mg.

The PTP of the present invention is excellent in water vapor barrier properties and production efficiency because a thermoplastic norbornene type resin excellent in water vapor barrier properties and vacuum forming properties is used in the sheet having pockets of the PTP.

We claim:

1. A press-through package obtained by placing objects to be packed in accommodating pockets formed in a sheet made of a thermoplastic norbornene resin having a glass transition temperature of 50°to 160° C., and then closing the openings of said pockets with another sheet to pack said.

2. A press-through package according to claim 1, wherein the sheet made of a thermoplastic norbornene resin has a water vapor transmission rate (in terms of a sheet thickness of 300 μm) of 1.0 $g/m^2 \cdot 24$ hours or less as measured under conditions of 40° C. and 90 RH %.

3. A press-through package according to claim 2, wherein the thermoplastic norbornene resin is a hydrogenated product of ring-opening polymerization product of a dicyclopentadiene monomer.

4. A press-through package according to claim 3, wherein the hydrogenated product of ring-opening polymerization product of a dicyclopentadiene monomer is one which contains 50% by weight or more of ring-opened repeating structural units derived from dicyclopentadiene, an alkyl-, alkylidene- or aromatic-substituted derivative of dicyclopentadiene, or a substituted product thereof having as the substituent(s) one or more halogens, hydroxyl groups, ester groups, alkoxy groups, cyano groups, amide groups, imide groups or silyl groups.

5. A press-through package according to claim 4, wherein the hydrogenated product of ring-opening polymerization product of a dicyclopentadiene monomer is a hydrogenated product of ring-opening polymerization product of dicyclopentadiene or an alkyl-, alkylidene- or aromatic-substituted derivative thereof.

6. A press-through package according to claim 4, wherein the hydrogenated product of ring-opening polymerization product of a dicyclopentadiene monomer is one which comprises 70% by weight or more of ring-opened repeating structural units derived from dicyclopentadiene or an alkyl-, alkylidene- or aromatic-substituted derivative thereof and 30% by weight or more of ring-opened repeating structural units derived from norbornene, norbornene, 1,4:5,8-dimethano-1,2,3,4,4a, 5,8,8a-octahydronaphthalene, or an alkyl-,alkylidene- or aromatic-substituted derivative thereof.

7. A press-through package according to claims 2, 3, 4, 5 or 6, wherein the number average molecular weight of the thermoplastic norbornene resin is 10,000 to 200,000 in terms of polystyrene, as measured by gel permeation chromatography using toluene as solvent.

8. A press-through package according to claims 2, 3, 4, 5, or 6 wherein the thermoplastic norbornene resin is one which is hydrogenated at a hydrogenation rate of 70% or more.

9. A press-through package according to claim 1, 3, 4, 5 or 6 wherein the sheet has a thickness in the pocket portions of 50 to 500 μm and a thickness in other portions of 100 to 500 μm.

10. A press-through package according to claims 1, 2, 3, 4, 5 or 6 wherein the sheet made of a thermoplastic norbornene resin is one which is obtained by forming accommodating pockets in an uniaxially oriented sheet.

11. A press-through package according to claim 1, wherein the thermoplastic norbornene resin is selected from the group consisting of ring-opening polymerization products of norbornene monomers, hydrogenated products thereof, addition polymers of norbornene monomers, and addition polymers of a norbornene monomer and an olefin.

* * * * *

UNITED STATES PATENT AND TRADEMARK OFFICE

CERTIFICATE OF CORRECTION

PATENT NO.: 5,686,156
DATED : Nov. 11, 1997
INVENTOR(S): Matsui et al.

It is certified that error appears in the above-identified patent and that said Letters Patent is hereby corrected as shown below:

Column 13, line 1, (claim 6), change "more" to --less--.

Signed and Sealed this

Second Day of June, 1998

*Attest:*

Bruce Lehman

BRUCE LEHMAN

*Attesting Officer*

*Commissioner of Patents and Trademarks*